US005421563A

United States Patent [19]

Holtermann et al.

[11] Patent Number: 5,421,563

[45] Date of Patent: Jun. 6, 1995

[54] SLIDE CLOSURE FOR MELTING POTS

[75] Inventors: Heinz Holtermann, Meerbusch; Arno Luven, Krefeld, both of Germany

[73] Assignee: Technometal Gesellschaft für Metalltechnologie mbH, Duisburg, Germany

[21] Appl. No.: 133,012

[22] PCT Filed: Apr. 3, 1993

[86] PCT No.: PCT/DE92/00283

§ 371 Date: Dec. 3, 1993

§ 102(e) Date: Dec. 3, 1993

[87] PCT Pub. No.: WO92/17298

PCT Pub. Date: Oct. 15, 1992

[30] Foreign Application Priority Data

Apr. 6, 1991 [DE] Germany ..... 41 11 211.3

[51] Int. Cl.[6] ..... B22D 41/24

[52] U.S. Cl. ..... 266/236; 222/600

[58] Field of Search ..... 222/600, 591, 590, 597; 266/236, 45

[56] References Cited

U.S. PATENT DOCUMENTS

| | | | |
|---|---|---|---|
| 3,352,465 | 11/1967 | Shapland | 222/600 |
| 3,604,603 | 9/1971 | Grosko et al. | 222/600 |
| 4,168,790 | 9/1979 | Lothmann et al. | 222/600 |

FOREIGN PATENT DOCUMENTS

| | | | |
|---|---|---|---|
| 1553542 | 2/1968 | France . | |
| 2140422 | 1/1973 | France . | |
| 2308448 | 12/1975 | France . | |
| 2506192 | 5/1982 | France . | |
| 3208101 | 3/1982 | Germany . | |
| 0761138 | 9/1980 | U.S.S.R. | 222/600 |

*Primary Examiner*—Scott Kastler

*Attorney, Agent, or Firm*—Robert W. Becker & Associates

[57] ABSTRACT

A slide closure for a melting pot has a bottom cartridge with a stationary bottom plate. The bottom cartridge is fixedly connected to the melting pot. Two guide blocks are displaceably connected to the underside of the bottom cartridge. A slide cartridge is displaceably guided in the guide blocks. The guide blocks are symmetrically arranged on opposite sides of the pour opening of the melting pot. The slide cartridge has two rod-shaped guide sections connected within the guide blocks and extending parallel to the axis of displacement of the slide cartridge on its lateral sides. The slide cartridge has a slide plate that is linearly displaceable relative to the bottom plate. The guide blocks have clamping members, symmetrically arranged relative to the pour opening of the melting pot, for pressing the slide plate against the bottom plate.

15 Claims, 2 Drawing Sheets

SLIDE CLOSURE FOR MELTING POTS

BACKGROUND OF THE INVENTION

The invention relates to a slide closure for melting pots, the slide closure having: a bottom plate that is stationarily arranged within a bottom cartridge connected to the melting pot, having a slide plate which is linearly displaceable relative to the bottom plate and arranged within a slide cartridge, whereby the slide cartridge is movable within guides that are connected to the bottom cartridge, and having two clamping members symmetrically arranged with respect to the pour opening for generating a clamping pressure of the slide plate against the bottom plate.

A slide closure of the aforementioned kind is known from German patent 32 08 101. In the known closure the slide plate is inserted into a slide cartridge forming a support frame which, in turn, is a part of a separate slide carriage. The slide carriage is guided within guides connected to a housing of the melting pot and is displaceable relative to the stationary bottom cartridge. The clamping members for generating the clamping pressure between the bottom plate and the slide plate is integrated into the slide carriage.

With the known slide closure it is disadvantageous that the slide closure has a complicated construction with a comparatively high number of parts which, in addition to a correspondingly high expenditure for manufacturing the slide closure and storing replacement parts, has especially the disadvantage that the manipulation of the slide closure during exchange of the bottom and slide plates, which are made of refractory material and are to be considered wear parts, is very complicated. For example, in the known slide closure, after loosening the clamping members, the guides for the slide carriage must be removed from the housing of the melting pot, the housing partially dismantled and, subsequently, the entire carriage unit removed from the housing before the wear parts in the form of the bottom and the slide plates are accessible for replacement.

A further disadvantage is that due to the clamping members arranged within the carriage the pressing of the plates against one another for different positions of carriage and housing, respectively, of slide plate and bottom plate, is subject to changes. In order to provide a uniform real pressure between the plates, a complicated follower arrangement for the slide plate, respectively, for its support frame, relative to the slide carriage is provided in the known slide closure.

A similar slide closure is known from French document 2 308 448. In the known arrangement the slide plate is positioned within a slide support which is anchored to a carriage. The carriage is slidable in a frame that is fixedly connected to the melting port. The frame itself is pivotably connected to the melting pot. For generating the required pressure between the bottom plate and the slide plate, the frame is fastened with stationarily positioned screws to the melting pot. For this known embodiment of a slide closure the same disadvantages as mentioned before are present, i.e., complicated construction and non-uniform pressing forces at the plates during displacement of the slide plate relative to the bottom plate.

It is therefore an object of the invention to improve a slide closure of the aforementioned kind such that its manufacture and maintenance is simplified and that the replacement of slide and bottom plates is facilitated.

SUMMARY OF THE INVENTION

The slide closure for a melting pot according to the present invention is primarily characterized by:

A bottom cartridge with a stationary bottom plate, the bottom cartridge fixedly connected to the melting pot;

Two guide blocks displaceably connected to an underside of the bottom cartridge;

A slide cartridge displaceably guided in the guide blocks, the guide blocks symmetrically arranged on opposite sides of a pour opening of the melting pot;

The slide cartridge having two rod-shaped guide sections connected within the guide blocks and extending parallel to an axis of displacement of the slide cartridge on lateral sides of the slide cartridge;

The slide cartridge comprising a slide plate that is linearly displaceable relative to the bottom plate; and The guide blocks comprising clamping members, symmetrically arranged relative to the pour opening of the melting pot, for pressing the slide plate against the bottom plate.

Advantageously, each lateral side of the slide cartridge has a recess parallel to the axis of displacement delimited on either end by receiving projections. The rod-shaped guide sections extend between the receiving projections, and the guide blocks have receiving openings for receiving the rod-shaped guide sections.

The length of the recesses determines the stroke of displacement of the slide cartridge, and the receiving projections serve as an abutment for the guide blocks for delimiting the stroke of displacement.

Preferably, the rod-shaped guide sections are guide rods guided within the guide blocks, and the slide cartridge is detachably connected with at least one guide rod to a corresponding guide block.

Expediently, the guide rods are rotatably connected to the slide cartridge. The slide cartridge, after releasing the guide rod on the locking side from the corresponding guide block, is pivotable about the other guide rod on the hinge side of the cartridge.

In a preferred embodiment of the present invention, the guide rod of the locking side includes an arresting lever at a free end thereof. The slide cartridge has a pocket for receiving the arresting lever in a locked position of the locking side.

On the locking side, the receiving projections have a slot facing away form the melting pot, and the guide rod has sections received within the receiving projections that are flattened, wherein a distance of the flattened sides of the sections is smaller than a width of the slots.

The guide rod on the locking side is longitudinally slidable in the receiving projections. In the locked position of the locking side, the guide rod with a portion having a cross-section without flattening is partially positioned in the receiving projections.

Preferably, pressure bolts with a bolt head are provided for securing the guide blocks to the bottom cartridge, and the clamping members are plate springs positioned under prestress between the bolt heads and the guide blocks.

Two pressure bolts with plate springs are arranged symmetrically to the pour opening of the melting pot such that a connecting line between the pressure bolts is at a right angle to the axis of displacement of the slide cartridge.

Expediently, guide pins are arranged on either side of the pressure bolts for positioning and guiding the guide blocks parallel to the axis of displacement.

The slide cartridge has a first opening for receiving the slide plate and the bottom cartridge has a second opening for receiving the bottom plate, wherein the first and the second openings are aligned with one another and are identically shaped.

A height of the bottom plate is preferably greater than a height of the second opening, and a height of the slide plate is preferably greater than a height of the first opening, the bottom plate and the slide plate being made of refractory material.

A sleeve support is expediently connected to the underside of the slide cartridge and an outlet sleeve is connectable within the sleeve support with a bayonet closure. For this purpose, the slide cartridge has a holder for receiving the sleeve support and the outlet sleeve.

The sleeve support advantageously includes a protective plate connected to a free end of the sleeve support for covering the bottom side of the slide closure.

The basic idea of the invention is that the slide cartridge is provided with two rod-shaped guide sections extending along its lateral sides that are parallel to the direction of displacement, which rod-shaped guide sections are guided within guide blocks connected to the bottom cartridge that is fastened to the melting pot on either side of the displacement axis and symmetrical to the pour opening; that the guide blocks are displaceably connected to the bottom cartridge; and that the clamping members are received in the guide blocks.

This has the primary advantage that, due to the direct connection and guiding of the slide cartridge via the guide blocks at the bottom cartridge, a complicated slide carriage is no longer needed, which not only results in a considerable simplification of the construction, but also in a simplification of the manipulation of the slide closure during replacement of bottom and slide plates. In particular, it is no longer necessary to provide a so-called slide workshop for servicing and maintenance of the complicated mechanism of the slide closure. The simple construction realized with the invention is based on only a few components so that therefore only a minimal storage of replacement parts is required.

Due to the open construction of the slide closure without frame, carriage etc., the otherwise required exterior cooling of the slide components is obsolete because a sufficient heat dissipation is ensured on all sides. Simultaneously, due to the simple mechanical construction of the inventive slide closure, a high operative safety even for high temperatures observed at the components of the slide closure is guaranteed.

Since the clamping members are arranged within the guide blocks and thus are independent of the movement of the slide cartridge and stationary relative to the pour opening of the melting pot, a uniform linear pressing force of the bottom plate and the slide plate relative to one another results advantageously whereby the preadjusted pressing force is uniformly maintained even for strong heat expansion of the refractory bottom and slide plates.

Furthermore, it is advantageous that even for small dimensions of the melting pot, for example, for a melting pot of 0.5 to 5 tons, no slide components extend past the melting pot so that the manipulation of the inventively embodied melting pot in steel works is substantially improved and the use of such a melting pot especially in vacuum facilities which have a limited amount of space, is possible.

According to one embodiment of the invention, it is suggested that the slide cartridge at its respective lateral sides has recesses extending between its outer corners, and that the guide sections extend between the corners forming receiving projections delimiting the recess and pass in this area through guide openings within the guide blocks. With such an embodiment, a compact construction is provided because the slide cartridge does not have any projecting parts for guiding that extend past its actual dimensions. Due to the recesses provided within the slide cartridge the stroke of displacement of the slide cartridge is at the same time determined whereby the receiving projections for the stroke of displacement form the abutments for the guide blocks.

According to a preferred embodiment of the invention, the guide sections provided at the slide cartridge are separate guide rods which extend through the guide openings of the guide blocks. At the same time, the slide cartridge is connected with at least one side to a guide rod at the receiving projections in a detachable manner. In an advantageous manner, this results in the possibility, after releasing the corresponding connection of receiving projections and guide rod, to pivot the slide cartridge about the axis formed by the other guide rod so that a locking side and a hinge side is formed. Advantageously, this results in a simple accessibility to the bottom plate and the slide plate arranged respectively in the bottom cartridge and the slide cartridge. Accordingly, a complicated mechanism for changing the refractory plates is obsolete; instead, the plates can be accessed in a very simple manner.

For embodying the detachable connection between the slide cartridge and the guide rod on the locking side of the slide cartridge, according to one embodiment the receiving projections on the locking side have a slot facing away from the melting pot and the guide rods at the same time are provided with flattened section in the area corresponding to the dimensions of the receiving projections. The flattened sections have a smaller distance relative to one another than the dimension of the slots. At the same time, the guide rod on the locking side is provided at one end with an arresting lever which in the locked position of the slide cartridge is secured with the guide rod in a holder provided at the slide cartridge. This results in the simple solution that by rotating the guide rod on the locking side with the arresting lever the flattened sections of the guide rod are positioned in alignment with the slots of the receiving projections so that the slide cartridge with the receiving projections can be pivoted away from the guide rod.

As a further securing means, according to another embodiment of the invention, it is suggested that the guide rod on the locking side is longitudinally slidably arranged within the corresponding receiving projections of the slide cartridge and in the locked position is partially positioned with without flattening within the receiving projections. In this manner it is ensured that even for an accidental rotation of the guide rod the corresponding flattened sections cannot pass through the slots within the receiving projections. This is only possible when due to a previous longitudinal displacement of the guide rod the flattened sections of the guide rod correspond to the extension of the slots within the receiving projections.

In a preferred embodiment of the invention, the two receiving projections for securing the guide rods, and thus the slide cartridge, are connected to the bottom cartridge with pressure bolts whereby the clamping members in the form of plate springs are positioned with prestress between the corresponding bolt head of the pressure bolt and the respective guide block. Thus, in a very simple manner, it is ensured that simultaneously the slide cartridge guided within the guide blocks is pressed with a corresponding prestress against the bottom cartridge. By adjusting a respective tensioning force of the pressure bolts, respectively, by exchanging the plate springs, the required pressure force is adjustable in a simple manner. In order to ensure the required parallel arrangement between the bottom cartridge and the slide cartridge with respect to the required real pressure force between the bottom plate and the slide plate, the guide blocks are additionally provided with guide pins for positioning the guide blocks relative to the bottom cartridge so that an angular displacement of the slide cartridge with respect to the bottom cartridge is prevented.

Inventively, the bottom cartridge and the slide cartridge are provided in a manner known per se with openings for receiving the refractory bottom plate and refractory slide plate, whereby inventively the bottom plate and the slide plate are identical in their shape. This has the advantage that the slide plate, depending on its load, can be exchanged with on another and can also be used in the turned-over state multiple times. This is especially achieved by ensuring that no special parts are needed at the bottom plate in order to conform it to the bottom cartridge; this is also true regarding the clamping members with respect to the slide plate.

According to one embodiment of the invention the height of the refractory plates for use as the bottom plate, respectively, slide plate, is slightly greater than the height of the corresponding opening within the bottom cartridge or the slide cartridge. With this embodiment it is ensured that the pressure force exerted via the clamping members acts only on the bottom, respectively, slide plate and is not reduced by abutment of other parts of the slide closure. At the same time this measure ensures that during displacement the friction force is reduced because only the refractory bottom and slide plates are gliding on one another.

When a slide closure is provided with an outlet sleeve, the present invention suggests that the slide cartridge at its side facing away from the melting pot is provided with a holder for a sleeve support of an outlet sleeve whereby the sleeve support is connectable to the holder in the manner of a bayonet closure. The sleeve support may simultaneously be used for supporting a protective plate to be arranged at the underside of the slide closure which protects the slide closure against heat exposure and splashing. It is also possible to use the protective plate as a mounting aid for the sleeve support when mounting it in the holder so that in this manner a simple exchange of the outlet sleeve is ensured.

BRIEF DESCRIPTION OF THE DRAWINGS

In the drawings an embodiment of the invention is represented which will be described in the following. It is shown in.

DESCRIPTION OF PREFERRED EMBODIMENTS

Figure 1:
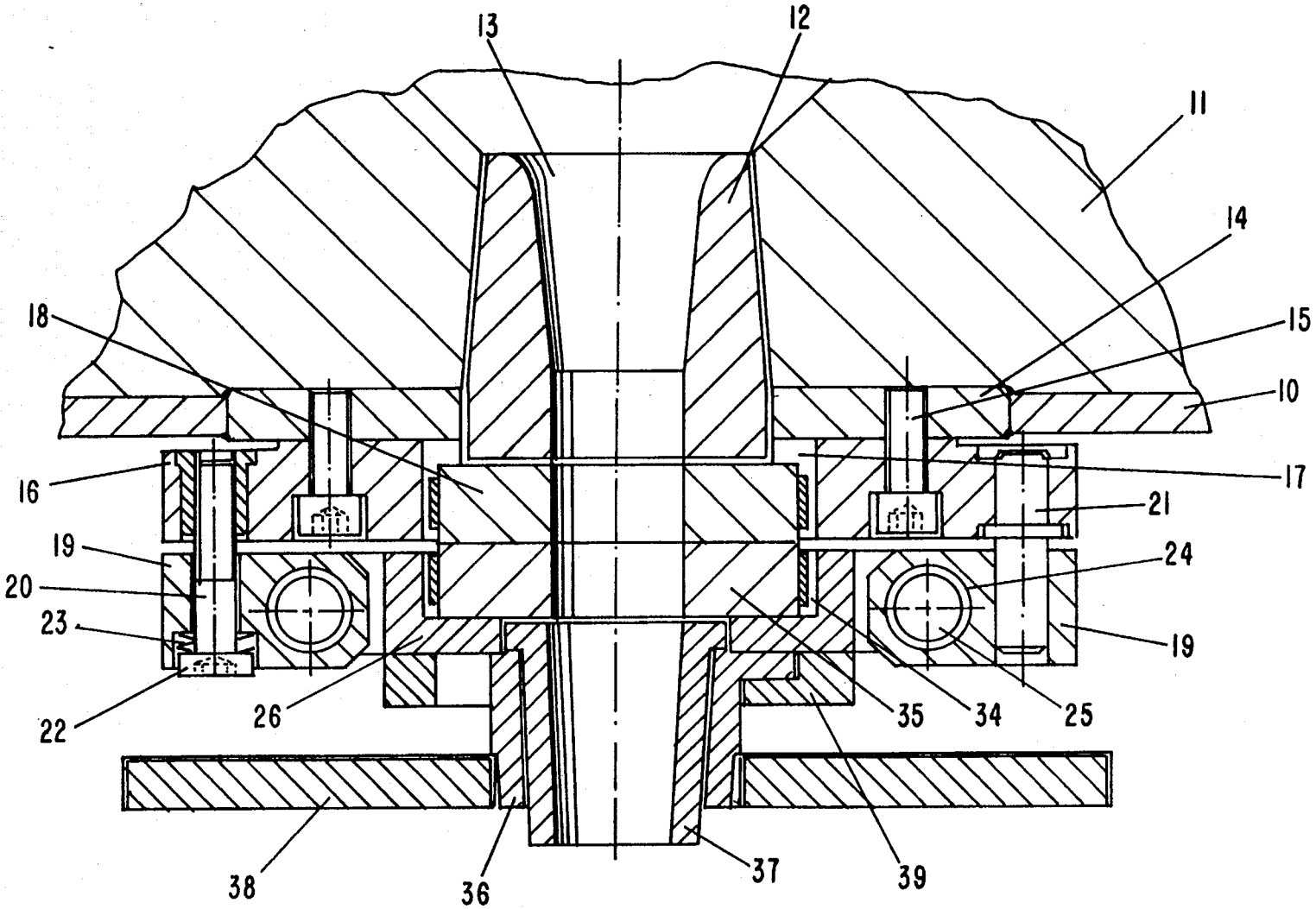
FIG. 1 the slide closure in its open position in a cross-sectional view.

FIG. 1 shows only the perforated block 11 of the melting pot 10 with bottom sleeve 12 and the pour opening 13 arranged therein. As a support for the slide closure a base plate 14 is fixedly connected to the bottom of the melting pot 10, preferably welded thereto, which receives the bottom sleeve 11.

At the base plate 14 a bottom cartridge 16 is stationarily connected via bolts 15. The cartridge 16 has an opening 17 for receiving the bottom plate 18 that is made of refractory material.

Two guide blocks 19 are connected to the bottom cartridge 16 in a symmetrical arrangement on either side of the pour opening 13 such that for this purpose a pressure bolt 20 and two guide pins 21 on each side are provided. The guide blocks are movable along the securing and guide elements 19, 20 relative to the bottom cartridge 16 such that between the bolt heads 22 and the guide blocks 19 clamping members 23 in the form of plate springs are provided which are positioned between the bolt heads 22 and the guide blocks 19. The guide pins 21 ensure a parallel alignment of the guide blocks 19 relative to the bottom cartridge 16 which is important for the mechanism of the slide closure; this will be explained infra. At the same time, the guide pins receive return force moments of the clamping members 23.

The guide blocks 19 have guide openings 24 facing the pour opening 13, in which guide openings 24 the guide rods 25 are longitudinally displaceable. The guide rods 25 are connected with the slide cartridge 26 which is arranged parallel to the bottom cartridge 16 so that the slide cartridge 26 via the guide rods 25 is secured and guided in the guide blocks 19.

The slide cartridge 26 has lateral sides facing the guide blocks 19 which are provided with recesses 27 so that at the outer corners receiving projections 28 for connecting the slide cartridge 26 to the guide rods 25 are formed. With respect to the accessibility of the plates arranged within the cartridges 16, 26, the slide cartridge 26 is embodied such that it is detachable on one side from the corresponding guide rod 25 so that here a locking side 30 results, while the other guide rod 25 forms a hinge side 29 about which the slide cartridge 26 can be pivoted in a downward direction.

On the locking side 30 the corresponding guide rod 25 is longitudinally slidably positioned and has an arresting lever 31 on one end which is pivotable together with the rotatably supported guide rod 25 and in its locked position is secured in a pocket 32 within the slide cartridge 26.

On the locking side 30 of the slide cartridge 26, the receiving projections 28 are slotted on a side facing away from the melting pot 10, and the guide rod 25, has over an area corresponding to the dimensions of the receiving projections 28, a flattened section 33 whereby the diameter of the guide rod 26 within the area of the flattened sections 33 is somewhat smaller than the width of the slot within the receiving projections 28 so that for an aligned arrangement of the slots and of the flattened sections a passage of the guide rods 25 through the receiving projections 28 of the slide cartridge 26 on the locking side 30 is possible.

The slide cartridge 26 is further provided with a corresponding opening 34 into which the slide plate 35 is inserted, whereby the bottom plate 18 and the slide plate 35 have an identical shape so that the plates can be exchanged with one another and can be used also in the turned-over position.

A holder 39 is connected to the slide cartridge 26 in which, in the manner of a bayonet closure, a sleeve support 36 is connected which, in turn, supports an outlet sleeve 37. To the sleeve support 36 a protective plate 38 is connected which protects the slide closure from below against heat and splashing of the molten material. The protective plate 38 is preferably round and has two handles, whereby at the same time a mounting aid for the sleeve support 36 during exchange of the outlet sleeve 37 is provided.

Figure 2:
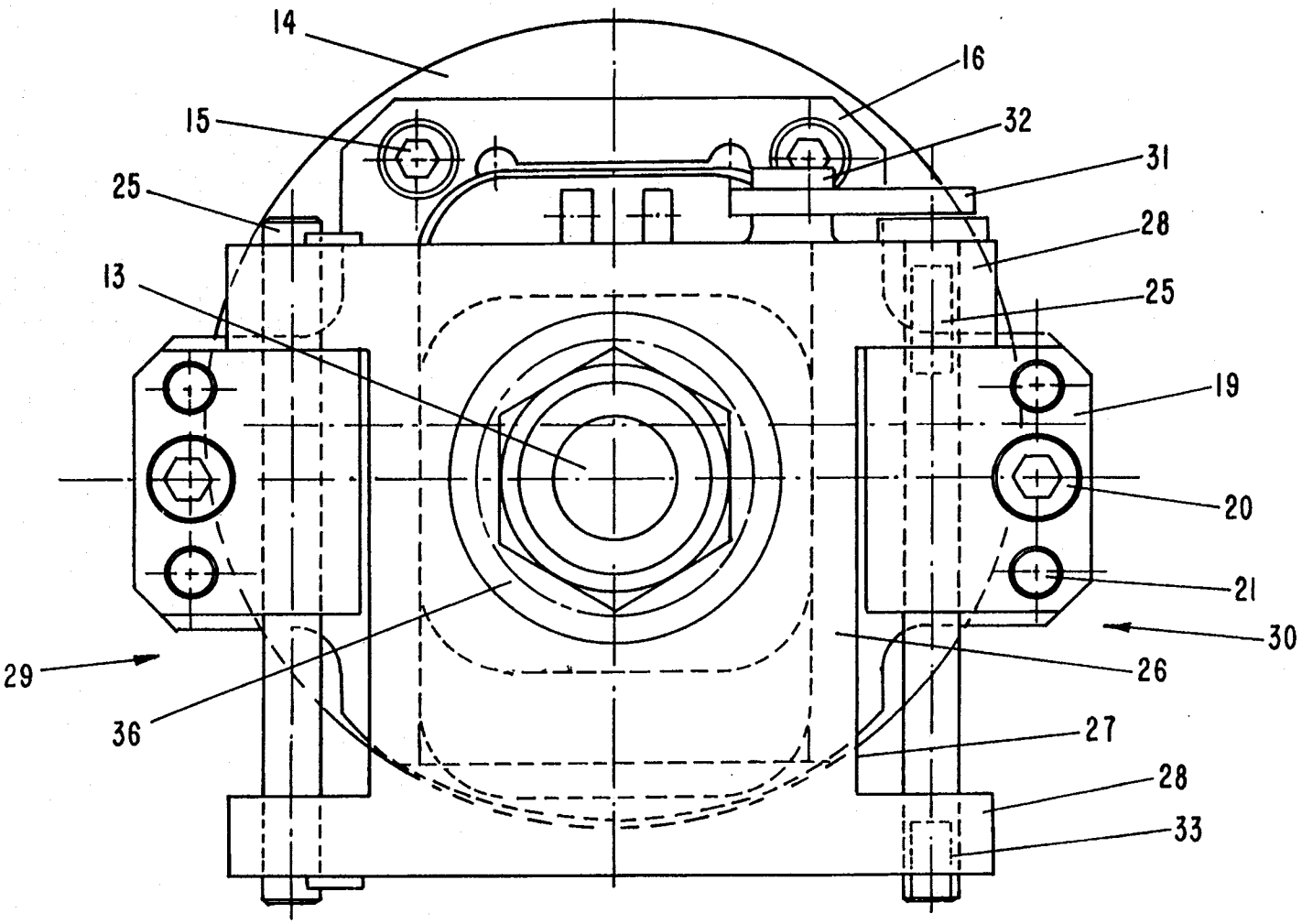
FIG. 2 the slide closure of FIG. 1 in a bottom view.

The drawings show the open position of the slide closure in which the corresponding outlet openings in the perforated block 11, the bottom plate 18, the slide plate 35 as well as the outlet sleeve 37 are aligned with one another. When it is desired to move the slide closure from this position into its closed position, the slide cartridge 27 is moved upwardly, in the representation of FIG. 2, until the guide blocks 19, in the shown representation spaced from the receiving projections, abut at the receiving projections 28. In this position the slide plate 35 is displaced with respect to the stationary bottom plate 18 so that the outlet opening within the bottom plate is covered. The movement of the slide cartridge 26 can be actuated by mechanical or hydraulic actuating devices, not represented in the drawings, whereby the corresponding drive systems of the slide closure are to be connected with the slide closure and can be removed with a few manipulative steps. Due to the excellent accessibility of the parts of the slide closure and the omission of a complicated mechanical system, respectively, carriage arrangement, the weight of the parts to be moved is comparatively small so that the drive system must not be very complicated.

When it is desired to replace or exchange the refractory plates 18, 35 within the bottom cartridge 16, respectively, the slide cartridge 26, in a first step the prestress within the area of the guide blocks 19 must be removed by loosening the two pressure bolts 20. Subsequently, on the locking side 30 the arresting lever 31 is displaced from its pocket 32 and pivoted about 90° so that the flattened sections 33 of the guide rod 25 are aligned with the slots of the receiving projections 28. Then the guide rod 25 is axially displaced until the flattened sections 33 are completely inserted into the receiving projections 28. Now the slide carriage 26 can be pivoted about the oppositely arranged hinge side about the respective guide rod 25 so that now the openings 17, respectively, 34 in the bottom cartridge 16, respectively, the slide cartridge 26 holding the plates 18, 35 are freely accessible. After completion of the exchange, the closure of the slide cartridge and the locking of the locking slide are carried out in the reversed order of steps, and after again tightening the pressure bolts 20 to the desired prestress the slide closure is again operative.

From the above description it is apparent that the simple mechanism of the slide closure requires only a very short exchange time and that mounting errors due to the low number of components and their simple arrangement relative to one another is impossible. At the same time, an adaptation to the site conditions with respect to the hinge side 29 and the locking side 30 of the slide closure is simply possible by changing sides of the respective guide rods 25.

The features of the present invention, as disclosed in the above description, the claims, the abstract, and the drawings, may be important for the realization of the present invention in various embodiments individually as well as in any desired combination.

The present invention is, of course, in no way restricted to the specific disclosure of the specification and drawings, but also encompasses any modifications within the scope of the appended claims.

What we claim is:

1. A slide closure for a melting pot, said slide closure comprising:

a bottom cartridge with a stationary bottom plate, said bottom cartridge fixedly connected to the melting pot;

two guide blocks displaceably connected to an underside of said bottom cartridge;

a slide cartridge displaceably guided in said guide blocks, said guide blocks symmetrically arranged on opposite sides of a pour opening of the melting pot;

said slide cartridge having two rod-shaped guide sections connected within said guide blocks and extending parallel to an axis of displacement of said slide cartridge on lateral sides of said slide cartridge;

said slide cartridge comprising a slide plate that is linearly displaceable relative to said bottom plate; and said guide blocks comprising clamping members, symmetrically arranged relative to the pour opening of the melting pot, for pressing said slide plate against said bottom plate.

2. A slide closure according to claim 1, wherein:

each said lateral side of said slide cartridge has a recess parallel to said axis of displacement delimited on either end by receiving projections;

wherein said rod-shaped guide sections extend between said receiving projections; and said guide blocks have receiving openings for receiving said rod-shaped guide sections.

3. A slide closure according to claim 2, wherein a length of said recesses determines a stroke of displacement of said slide cartridge and wherein said receiving projections serve as an abutment for said guide blocks for delimiting said stroke of displacement.

4. A slide closure according to claim 2, wherein said rod-shaped guide sections are guide rods guided within said guide blocks and wherein said slide cartridge is detachably connected with at least one said guide rod to a corresponding said guide block.

5. A slide closure according to claim 4, wherein said guide rods are rotatably connected to said slide cartridge and wherein said slide cartridge after releasing one said guide rod on a locking side of said slide cartridge from said corresponding guide block is pivotable about the other one of said guide rods on hinge side of said cartridge.

6. A slide closure according to claim 5, wherein said guide rod of said locking side includes an arresting lever at a free end thereof and wherein said slide cartridge has a pocket for receiving said arresting lever in a locked position of said locking side.

7. A slide closure according to claim 5, wherein on said locking side said receiving projections have a slot facing away form the melting pot and wherein said guide rod has sections received within said receiving projections that are flattened, wherein a distance of flattened sides of said sections is smaller than a width of said slots.

8. A slide closure according to claim 7, wherein said guide rod on said locking side is longitudinally slidable in said receiving projections and wherein in a locked position of said locking side said guide rod with a portion having a cross-section without flattening is partially positioned in said receiving projections.

9. A slide closure according to claim 1, further comprising pressure bolts with a bolt head for securing said guide blocks to said bottom cartridge and wherein said clamping members are plate springs positioned under prestress between said bolt heads and said guide blocks.

10. A slide closure according to claim 9, wherein two said pressure bolts with said plate spring are arranged symmetrically to the pour opening of the melting pot, wherein a connecting line between said pressure bolts is at a right angle to said axis of displacement of said slide cartridge.

11. A slide closure according to claim 10, further comprising guide pins arranged on either side of said pressure bolts for positioning and guiding said guide blocks parallel to said axis of displacement.

12. A slide closure according to claim 1, wherein said slide cartridge has a first opening for receiving said slide plate and said bottom cartridge has a second opening for receiving said bottom plate, wherein said first and said second openings are aligned with one another and are identically shaped.

13. A slide closure according to claim 12, wherein a height of said bottom plate is greater than a height of said second opening and wherein a height of said slide plate is greater than a height of said first opening, and wherein said bottom plate and said slide plate are made of refractory material.

14. A slide closure according to claim 1, further comprising a sleeve support connected to an underside of said slide cartridge and an outlet sleeve connectable within said sleeve support with a bayonet closure, said slide cartridge having a holder for receiving said sleeve support and said outlet sleeve.

15. A slide closure according to claim 14, wherein said sleeve support includes a protective plate connected to a free end of said sleeve support for covering a bottom side of said slide closure.

* * * * *